US007028324B2

(12) United States Patent
Shimizu et al.

(10) Patent No.: US 7,028,324 B2
(45) Date of Patent: Apr. 11, 2006

(54) DIGITAL BROADCASTING SYSTEM AND EVENT MESSAGE TRANSMISSION METHOD

(75) Inventors: Hidekazu Shimizu, Oi-machi (JP); Toshihiro Hishida, Kobe (JP); Junichi Hirai, Suita (JP); Hideki Kagemoto, Nara (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 1012 days.

(21) Appl. No.: 09/777,023

(22) Filed: Feb. 5, 2001

(65) Prior Publication Data

US 2001/0013130 A1 Aug. 9, 2001

(30) Foreign Application Priority Data

Feb. 3, 2000 (JP) ..... 2000-026797
Feb. 22, 2000 (JP) ..... 2000-044983

(51) Int. Cl.
*H04N 7/25* (2006.01)
*H04N 7/10* (2006.01)

(52) U.S. Cl. ..... 725/32; 715/723; 715/731

(58) Field of Classification Search ..... 725/32–37, 725/722; 715/716, 723, 731; H04N 7/025, H04N 7/10

See application file for complete search history.

(56) References Cited

U.S. PATENT DOCUMENTS 4,015,074 A * 3/1977 Inoue et al. ..... 725/33
5,260,778 A * 11/1993 Kauffman et al. ..... 725/33
5,760,820 A * 6/1998 Eda et al. ..... 725/33
5,945,986 A * 8/1999 Bargar et al. ..... 715/500.1
6,496,981 B1 * 12/2002 Wistendahl et al. ..... 725/112
6,543,051 B1 * 4/2003 Manson et al. ..... 725/33

OTHER PUBLICATIONS

"Operational Guidelines for Digital Satellite Broadcasting Services Using Broadcasting Satellites," ARIB Technical Report (ARIB TR-B15 Version 1.0) Oct. 26, 1999, w/partial translation.

"Data Coding and Transmission Specification for Digital Broadcasting," ARIB Standard (ARIB STD-B24) Version 1.0) Oct. 26, 1999, with English version.

* cited by examiner

*Primary Examiner*—Vivek Srivastava

(57) ABSTRACT

A digital broadcasting system includes an authoring apparatus and a transmission apparatus. The authoring apparatus generates event information, which defines an event message that should be transmitted immediately after an operator's instruction to transmit the event message is received, and adds the event information to a content. The authoring apparatus then extracts the event information from the content by referring to tag information and transfers the extracted event information to the transmission apparatus. The transmission apparatus stores the event message defined by the event information transferred from the authoring apparatus. According to an operator's instruction to transmit the event message, the transmission apparatus issues the event message, and multiplexes and transmits the issued event message and the content.

32 Claims, 15 Drawing Sheets

FIG. 4

```
<REPETITIVE TRANSMISSION id="REPETITIVE TRANSMISSION DATA 1" start_time="00:00:00" duration="00:20:00" >
  <MODULE id="MODULE 1" >
    <resource type="SCENE" src="NEWS HEADLINE.bml" >
    <resource type="SCENE" src="DETAILED NEWS 1.bml" >
    <resource type="SCENE" src="DETAILED NEWS 2.bml" >
        :
    <resource type="BITMAP IMAGE" src="BACKGROUND STILL IMAGE.bmp" >
        :
    </MODULE>
</REPETITIVE TRANSMISSION>
```

122

122b

```
<audio id="NEWS AUDIO 1" component_tag="0x40" >
<video id="NEWS VIDEO 2" component_tag="0x50" >
```

122c

```
<event_msg   id="EVENT MESSAGE 1"
             message_id="0001"
             start_time="00:10:00"
             num_times="20"
             interval="5"
             private_data="This program has been sponsored by OO Foods Corp.,ΔΔ Electric Corporation, and XX Motor Corporation." />
```

122d

```
<MANUAL ISSUE>
  <event_msg  id="EVENT MESSAGE 2"
              message_id="0002"
              num_times="20"
              interval="5"
              private_data="Up-to-the-minute reports on election,OO is projected to win." />
  <event_msg  id="EVENT MESSAGE 3"
              message_id="0003"
              num_times="20"
              interval="5"
              private_data="An earthquake occurred." />
  <event_msg  id="EVENT MESSAGE 4"
              message_id="0004"
              num_times="20"
              interval="5"
              private_data="The next is Today's Fortune-Telling." />
</MANUAL ISSUE>
```

122e

FIG. 11

```
<REPETITIVE TRANSMISSION id="REPETITIVE TRANSMISSION DATA 1" start_time="00:00:00" duration="00:20:00" >
    <MODULE id="MODULE 1" >
        <resource type="SCENE" src="NEWS HEADLINE.bml" >
        <resource type="SCENE" src="DETAILED NEWS 1.bml" >
        <resource type="SCENE" src="DETAILED NEWS 2.bml" >
            :
        <resource type="BITMAP IMAGE" src="BACKGROUND STILL IMAGE.bmp" >
            :
    </MODULE>
</REPETITIVE TRANSMISSION>

<audio id="NEWS AUDIO 1" component_tag="0x40" >
<video id="NEWS VIDEO 2" component_tag="0x50" >


<event_msg   id="EVENT MESSAGE 1"
             message_id="0001"
             start_time="00:10:00"
             num_times="20"
             interval="5"
             private_data="This program has been sponsored by Foods Corp.,△△ Electric Corporation, and XX Motor Corporation." />

<IMMEDIATE>
  <event_msg  id="EVENT MESSAGE 2"
              message_id="0002"
              num_times="20"
              interval="5"
              private_data="Up-to-the-minute reports on election,○○ is projected to win." />
  <event_msg  id="EVENT MESSAGE 3"
              message_id="0003"
              num_times="20"
              interval="5"
              private_data="An earthquake occurred." />
  <event_msg  id="EVENT MESSAGE 4"
              message_id="0004"
              num_times="20"
              interval="5"
              private_data="The next Today's Fortune-Telling." />
</IMMEDIATE>
```

222

222b

FIG. 15

```
<REPETITIVE TRANSMISSION  id= "REPETITIVE TRANSMISSION DATA 1"  start_time= "00:00:00"  duration= "00:20:00" >
   <MODULE id= "MODULE 1" >
      <resource type= "SCENE"  src= "NEWS HEADLINE.bml" >
      <resource type= "SCENE"  src= "DETAILED NEWS 1.bml" >
      <resource type= "SCENE"  src= "DETAILED NEWS 2.bml" >
                  :
      <resource type= "BITMAP IMAGE"  src= "BACKGROUND STILL IMAGE.bmp" >
                  :
   </MODULE>
</REPETITIVE TRANSMISSION>

<audio id= "NEWS AUDIO 1"  component_tag= "0x40" >
<video id= "NEWS VIDEO 2"  component_tag= "0x50" >


<event_msg id= "event message 1"
                  message_id= "0001"
                  start_time= "00:10:00"
                  num_times= "20"
                  interval= "5"
                  private_data= "This program has been sponsored by Foods Corp.,ΔΔ Electric Corporation, and XX Motor Corporation." />

<MANUAL ISSUE src= "event_msg.emf" >

</MANUAL ISSUE>
```

400

```
<event_msg        id= "EVENT MESSAGE 2"
                  message_id= "0002"
                  num_times= "20"
                  interval= "5"
                  private_data= "Up-to-the-minute reports on election,OO is projected to win." />
<event_msg        id= "EVENT MESSAGE 3"
                  message_id= "0003"
                  num_times= "20"
                  interval= "5"
                  private_data= "An earthquake occurred." />
<event_msg        id= "EVENT MESSAGE 4"
                  message_id= "0004"
                  num_times= "20"
                  interval= "5"
                  private_data= "The next Today's Fortune-Telling." />
```

401

DIGITAL BROADCASTING SYSTEM AND EVENT MESSAGE TRANSMISSION METHOD

BACKGROUND OF THE INVENTION

1. Field of the Invention

The present invention relates to a digital broadcasting system and a method for use in the digital broadcasting system, and more specifically relates to a digital broadcasting system that transmits an event message and an event message transmission method.

2. Description of the Related Art

Efforts are recently being made to provide digital broadcasting services. In Japan, BS (broadcasting satellite) digital broadcasting services have started in December 2000 and it is planned to begin digital broadcasting services using ground waves in 2003.

Among these digital broadcasting services, there is data broadcasting where interactive contents are provided to viewers. The data broadcasting is described in detail in various documents, such as "Data Coding and Transmission Specification for Digital Broadcasting" (ARIB STD-B24, Ver. 1.0) and "Operational Guidelines for Digital Satellite Broadcasting Services Using Broadcasting Satellites" (ARIB TR-B15, Ver. 1.0)).

An event message transmission method is used in the digital broadcasting. With this method, immediately after the instruction to transmit an event message (message information) is inputted or at a specified time to transmit the event message, the event message is transmitted from a broadcast station to each receiver that runs an application. After receiving the event message, each receiver displays the event message on a television screen or performs predetermined processing (event processing) using the event message as a trigger. Note that there are two types of event messages: event messages (called "manual event messages" in this specification) that are transmitted immediately after the instructions to transmit the event messages are inputted and event messages (called "time event messages" in this specification) that are transmitted at specified times.

FIG. 1 is a block diagram showing the construction of a conventional digital broadcasting system 500. The digital broadcasting system 500 is a computer system that supports the process from the production and editing of contents for digital broadcasting to the transmission of the contents over broadcasting waves. As shown in FIG. 1, the digital broadcasting system 500 includes an authoring unit 501, a content storing unit 520, a content registering unit 530, and a transmission system 510. The transmission system 510 includes a video and audio transmission control unit 511, a content transmission control unit 512, a manual event message generating and issuing unit (hereinafter abbreviated to "manual event message unit") 513, and a multiplexing unit 514.

The authoring unit 501 is an editing apparatus that produces contents for data broadcasts (the contents for data broadcasts are hereinafter simply referred to as the "contents").

The content storing unit 520 is a storing apparatus that stores the produced contents. FIG. 1 shows an example content (a content 521) stored in the content storing unit 520. As shown in this drawing, the content 521 includes various files that can be roughly classified into three types of files: a content structure information file 522, scene information files 523, and monomedia information files 524.

The content structure information file 522 is a file that holds information concerning the whole structure of the content 521. Each scene information file 523 includes scene information specifying the components of a display screen. Each monomedia information file 524 includes a monomedia, such as a bitmap, that is a component of a scene.

The content registering unit 530 reads, according to a certain schedule, the contents stored in the content storing unit 520, converts the read contents to be in a MPEG2 section format, and registers the converted contents at the transmission system 510 (transfers the converted contents to the content transmission control unit 512).

The video and audio transmission control unit 511 is a real-time encoder that reads video and audio information from a VTR (videotape recorder) or another apparatus, generates MPEG2 elementary streams (video streams and audio streams) by subjecting the video and audio information to compression coding, and outputs the MPEG2 elementary streams to the multiplexing unit 514.

The content transmission control unit 512 performs the following operations according to a certain program schedule. The content transmission control unit 512 generates carousel data streams from the contents sent from the content registering unit 530 and outputs the carousel data streams to the multiplexing unit 514. Note that the carousel data streams are streams of information (carousel data) that is to be repeatedly broadcasted with a data carousel method.

The manual event message unit 513 is a terminal apparatus that includes a manual event message storing unit 513*a*, such as a hard disc drive apparatus, and includes a graphical user interface for an operator. According to the instructions inputted by the operator through the graphical user interface, the manual event message unit 513 generates and edits a manual event message and stores the manual event message in the manual event message storing unit 513*a*. Immediately after receiving an operator's instruction to issue the manual event message, the manual event message unit 513 reads the manual event message from the manual event message storing unit 513*a* and outputs the read manual event message to the multiplexing unit 514.

The multiplexing unit 514 generates packets from the video and audio streams, carousel data streams, and manual event message that are respectively sent from the video and audio transmission control unit 511, the content transmission control unit 512, and the manual event message unit 513. The multiplexing unit 514 then multiplexes the packets to generate a transport stream and transmits the transport stream over a broadcasting wave.

The following description concerns the processing of a manual event message 3 shown in FIG. 1 by the conventional digital broadcasting system 500 having the stated construction.

The operation procedure that should be performed by each receiver that receives the manual event message 3 is embedded into the content 521 as a program by the authoring unit 501. More specifically, as shown in FIG. 1, the operation procedure is written as a program in a scene information file 523*a*. In this example, the scene information file 523*a* includes a program for having each receiver that receives the event message 3 display message data included in the event message 3 on a screen.

The operator defines (generates) each manual event message by interacting with the manual event message unit 513 and each defined manual event message is stored in the manual event message storing unit 513*a*. Here, like a manual event message 513*b* shown in FIG. 1, each manual event message includes a name ID, a message ID, message data, the number of transmissions, and a transmission interval.

Immediately after receiving an operator's instruction to transmit a manual event message, the manual event message unit 513 repeatedly outputs a message ID and message data of the event message to the multiplexing unit 514 at a specified transmission interval for a specified number of times(corresponding to the number of transmissions included in the event message).

Each receiver has already received a program corresponding to the manual event message (a program having the message ID of the manual event message). Therefore, immediately after receiving the manual event message, each receiver displays message data included in the manual event message by superimposing the message data on a current image displayed on a television screen. As a result, urgent messages (such as the report of an earthquake) that need to be asynchronously transmitted is immediately transmitted from a broadcast station to each receiver.

SUMMARY OF THE INVENTION

The first object of the present invention is to provide a digital broadcasting system and an event message transmission method, each of which allows operations concerning manual event messages to be performed smoothly.

The second object of the present invention is to provide a digital broadcasting system and an event message transmission method, each of which allows manual event messages to be generated in advance.

The third object of the present invention is to provide a digital broadcasting system and an event message transmission method, each of which produces a content where manual event messages are distinguished from time event messages.

The stated objects are achieved by a digital broadcasting system including an authoring apparatus and a transmission apparatus that transmits a content transferred from the authoring apparatus, where the authoring apparatus includes: a generating unit for generating event information, which defines an event message that should be transmitted immediately after an operator's instruction to transmit the event message is inputted, and a processing unit for processing a content, which should be transferred to the transmission apparatus, by adding the generated event information.

With this construction, during the production of a content, it is possible for a producer to define (generate) manual event messages that are likely to become necessary, in addition to programs describing event processing that should be performed by receivers that receive the manual event messages. This means that the digital broadcasting system simplifies the operations concerning manual event messages that have conventionally been complicated because different apparatuses are used to write programs for manual event messages and to define the manual event messages.

Here, the generated event information may include the event message and tag information, the tag information allowing the authoring apparatus to recognize that the event message should be (a) transferred to the transmission apparatus before the operator's instruction is inputted and (b) transmitted from the transmission apparatus immediately after the operator's instruction is inputted.

Also, the authoring apparatus further may include: an extracting unit for extracting the event information from the processed content by referring to the tag information; and a transferring unit for transferring the extracted event information to the transmission apparatus, and the transmission apparatus may include: a storing unit for storing the event message included in the event information transferred from the authoring apparatus; an issuing unit for issuing the event message stored in the storing unit by receiving the operator's instruction; and a multiplexing unit for multiplexing and transmitting the issued event message with a content that has been transferred from the authoring apparatus.

With these constructions, each manual event message, which has been defined during the production of a content, is extracted at the authoring apparatus and is accumulated in the transmission apparatus. This saves the operator from generating each event message at the transmission apparatus when the event message becomes necessary. That is, it is enough for the operator to generate only event messages that unexpectedly become necessary later at the transmission apparatus. Also, it becomes possible to define manual event messages using a markup language such as HTML. As a result, the compatibility with other description languages can be easily maintained.

Here, the generated event information may include the event message and tag information, the tag information allowing the authoring apparatus to recognize that the event message should be issued to the transmission apparatus and transmitted therefrom immediately after the operator's instruction is inputted.

Also, the authoring apparatus may further include: an extracting unit for extracting the event information from the processed content by referring to the tag information; a storing unit for storing the event message included in the extracted event information; and an issuing unit for issuing the event message stored in the storing unit to the transmission apparatus by receiving the operator's instruction, and the transmission apparatus may include: a multiplexing unit for multiplexing and transmitting the issued event message with a content that has been transferred from the authoring apparatus.

This construction allows the producer to perform the generation, accumulation, and issuance operations concerning manual event messages at the authoring apparatus (in an upstream process) instead of at the transmission apparatus. This means that it is possible for the producer to efficiently manage manual event messages by defining event messages, which are likely to become necessary, during the production of the content at the authoring apparatus and generating and issuing only event messages that unexpectedly become necessary later at a conventional transmission apparatus. Also, it becomes possible to define manual event messages using a markup language such as HTML. As a result, the compatibility with other description languages can be easily maintained.

Here, the authoring apparatus may further includes an obtaining unit for obtaining a content, to which event information has been added, from the outside, and the extracting unit may extract the event information from the obtained content. Also, the obtaining unit may obtain a content, to which event information has been added, from a transportable recording medium or via a network.

With this construction, contents produced at other authoring apparatuses are obtained from recording media or via networks, and the generation, accumulation, and issuance operations concerning manual event messages are performed for the obtained contents.

Also, the present invention may be realized as processing procedures of the characteristic construction elements of the digital broadcasting system of the present invention. Here, the processing procedures may be achieved as a program to be executed by a computer.

Further, the present invention may be realized as a computer-readable recording medium that records a content for digital broadcasting. The recorded content includes (i) event information defining a manual event message that should be transmitted to each receiving apparatus immediately after an operator's instruction to transmit the event message is inputted and (ii) a program that describes processing, which each receiving apparatus should perform when receiving the manual event message.

The content stated above includes statements defining manual event messages that are likely to become necessary, in addition to programs describing event processing that should be performed by receivers that receive the manual event messages. This allows a broadcast station to provide each receiver with an advanced service where each receiver performs predetermined processing according to the event information that has been asynchronously transmitted from the broadcast station.

As described above, the present invention allows each broadcast station to smoothly perform the generation, accumulation, and issuance operations concerning manual event messages. As a result, the present invention has a great practical use as a digital broadcasting system and an event message transmission method.

BRIEF DESCRIPTION OF THE DRAWINGS

These and other objects, advantages and features of the invention will become apparent from the following description thereof taken in conjunction with the accompanying drawings which illustrate a specific embodiment of the invention.

In the drawings:

FIG. 4 shows an example program list showing the content of a content structure information file of the first embodiment;

FIG. 11 shows an example program list showing the content of a content structure information file of the second embodiment;

FIG. 15 shows the file structure of the case where each statement defining a manual event message is written in an external reference file.

DESCRIPTION OF THE PREFERRED EMBODIMENTS

Embodiments of a digital broadcasting system of the present invention are described below with reference to the drawings.

<First Embodiment>

Figure 1:
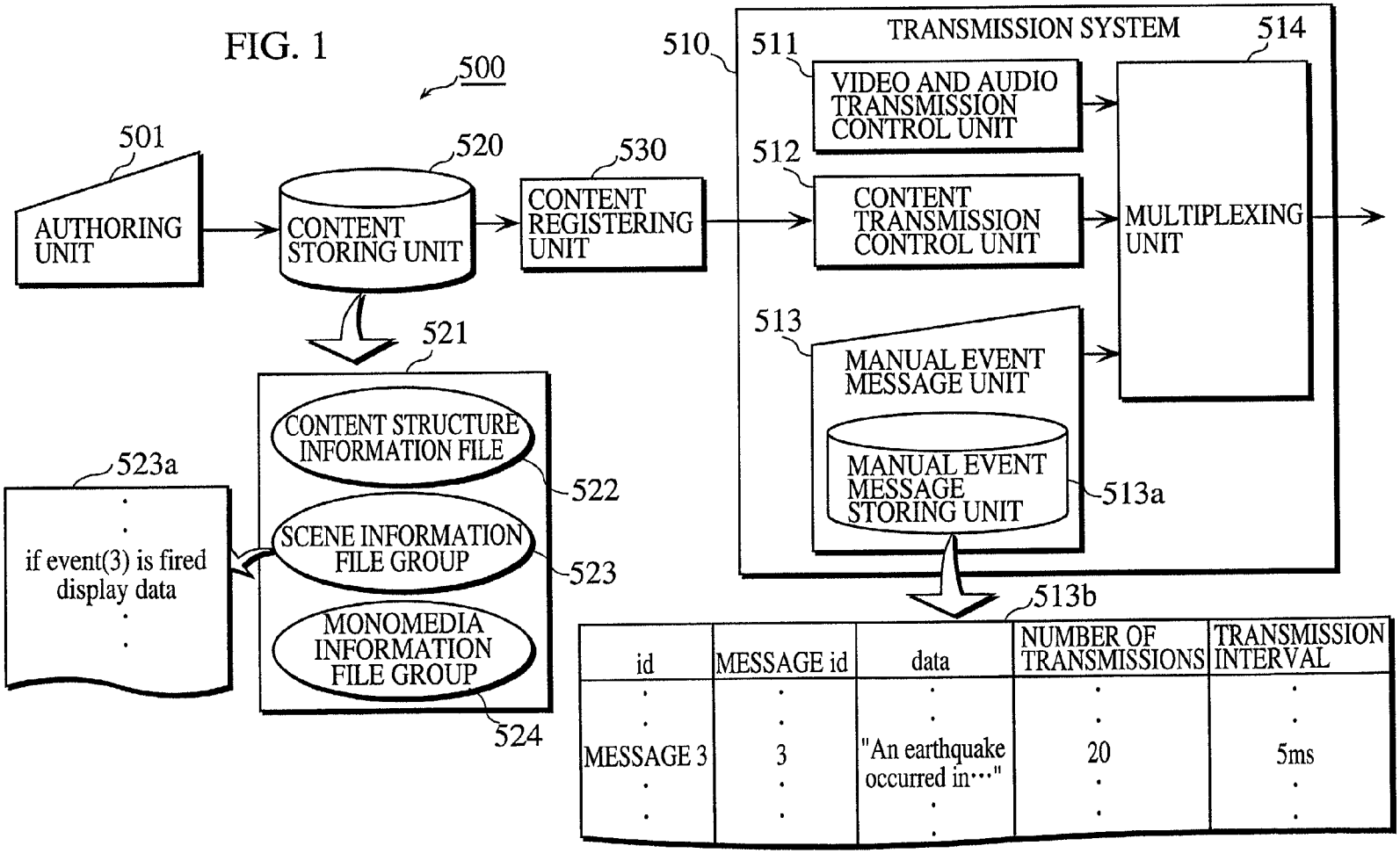
FIG. 1 is a functional block diagram showing the construction of a conventional digital broadcasting system.
Figure 2:
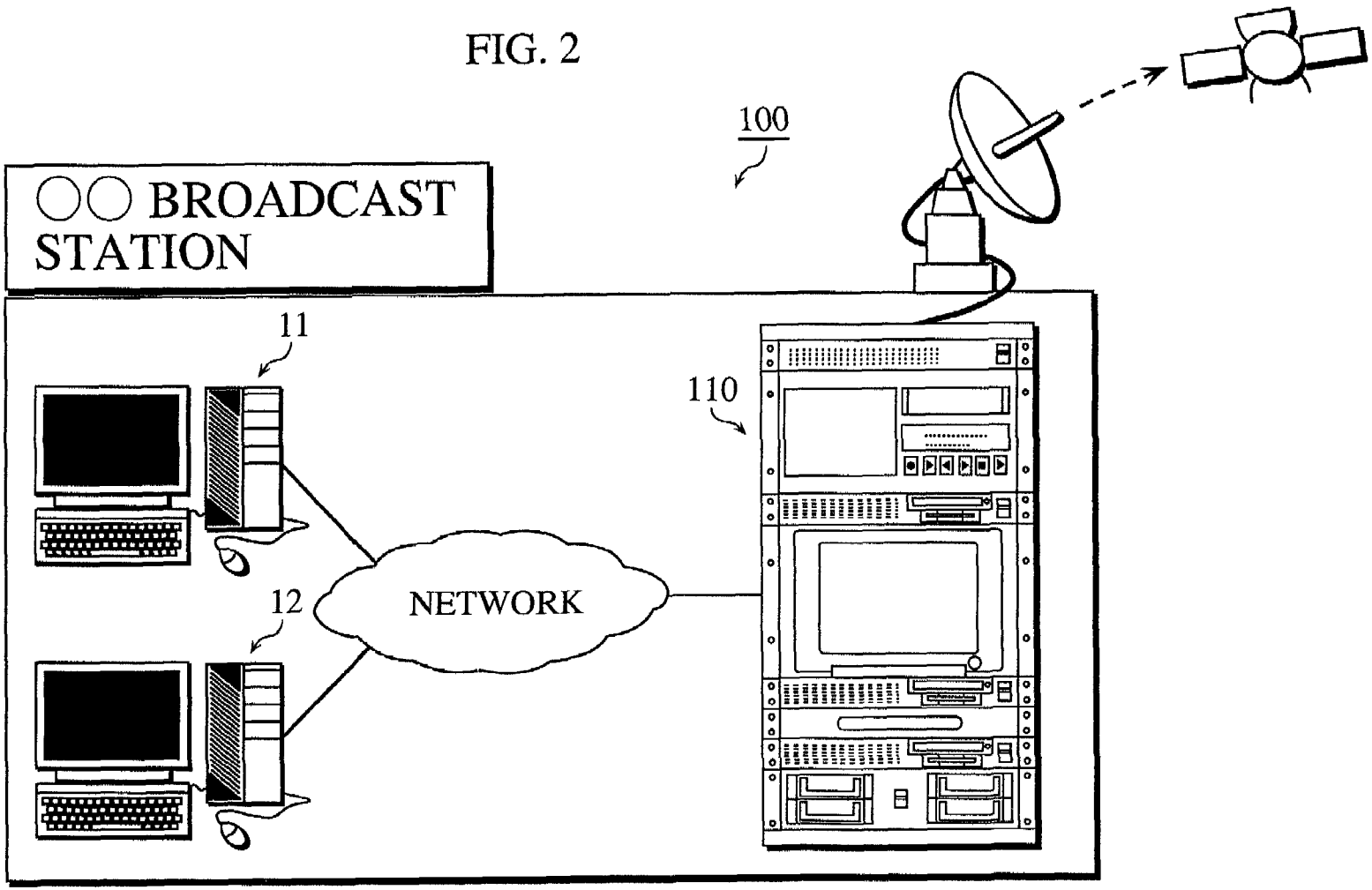
FIG. 2 shows the overall construction of a digital broadcasting system of the first embodiment.

FIG. 2 shows the overall construction of a digital broadcasting system 100 of the first embodiment. The digital broadcasting system 100 allows a manual event message to be defined during the production of a content and includes authorizing apparatuses 11 and 12 and a transmission system 110. In this system 100, the authoring apparatuses 11 and 12 are each connected to the transmission system 110 via a LAN (local area network). It should be noted here that the authoring apparatuses 11 and 12 have the same construction and so only the authoring apparatus 11 is described below.

Figure 3:
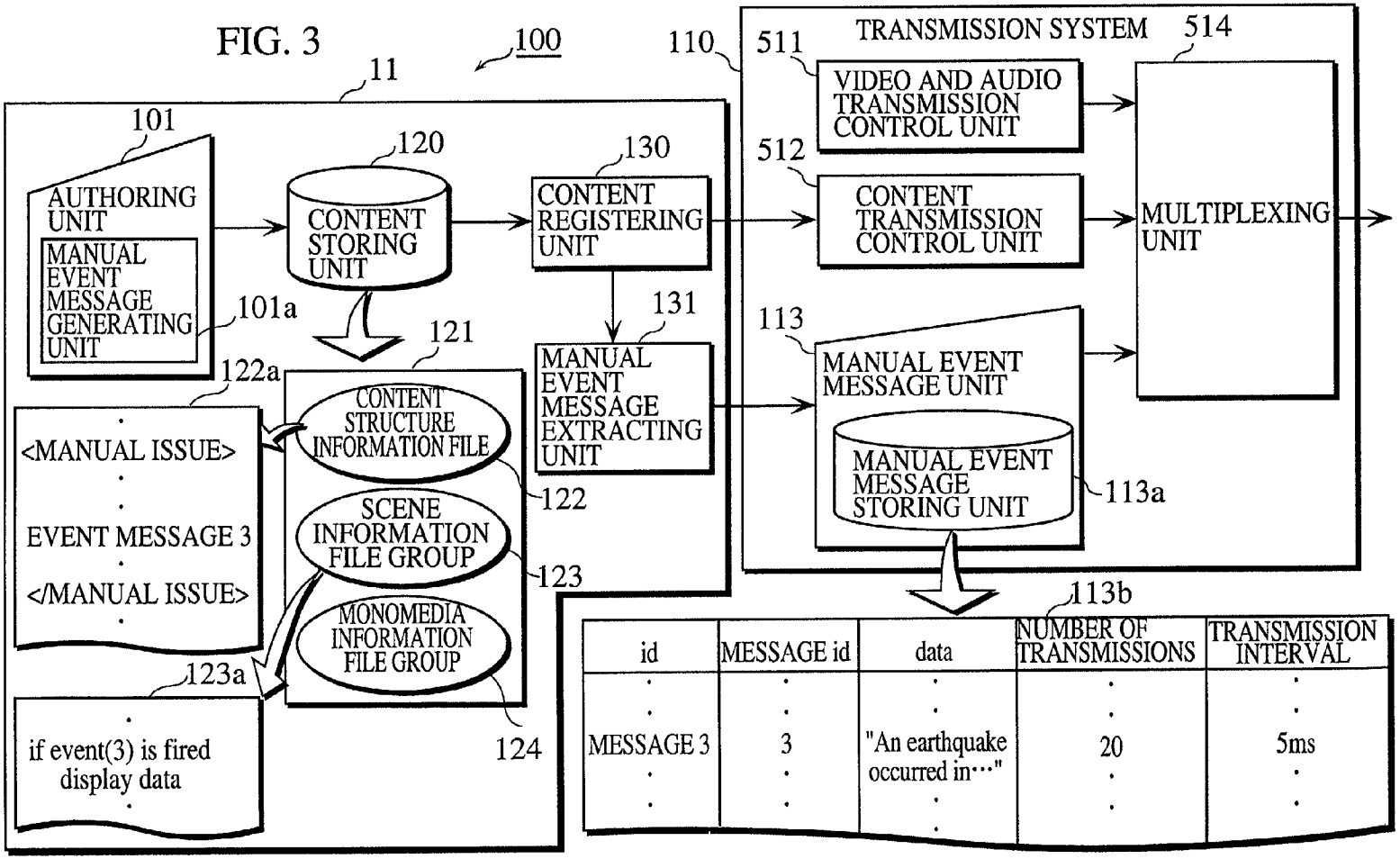
FIG. 3 is a functional block diagram showing the construction of the digital broadcasting system of the first embodiment.

FIG. 3 is a functional block diagram showing the construction of the digital broadcasting system 100 of the first embodiment.

As shown in this drawing, the authoring apparatus 11 includes an authoring unit 101, a content storing unit 120, a content registering unit 130, and a manual event message extracting unit 131.

Here, manual event messages are event messages that are transmitted immediately after the instructions to transmit the event messages are inputted at broadcast stations. Note that in addition to the manual event messages, there are time event messages that are transmitted at times specified at broadcast stations.

The transmission system 110 includes a video and audio transmission control unit 511, a content transmission control unit 512, a manual event message generating and issuing unit (hereinafter abbreviated to "manual event message unit") 113, and a multiplexing unit 514. Note that the same construction elements as those described in the section "Description of the Related Art" of this specification are assigned the same reference numbers and are not described below.

The authoring unit 101 is an apparatus that includes authoring software for editing interactive contents for digital broadcasts, basic software (such as Windows (Microsoft Corp.)) on which the authoring software runs, and a personal computer. With this construction, the authoring unit 101 produces and edits contents according to the instructions inputted by an operator. The authoring unit 101 includes a manual event message generating unit 101*a* that generates manual event messages. Note that the authoring software includes a general-purpose text editor as well as authoring tools specialized in data broadcasts.

The manual event message generating unit 101*a* provides a graphical user interface for a producer who is to define manual event messages. Through the graphical user interface, the producer inputs various instructions and the definition of each manual event message. As a result, the manual event message generating unit 101*a* generates each statement that defines a manual event message in a certain notation, embeds each generated statement into a content structure information file 122, and outputs the content structure information file 122 to the content storing unit 120.

The content storing unit 120 is a storing apparatus that stores contents produced by the authoring unit 101 and includes, for instance, a large-capacity hard disc drive. A content 121 stored in the content storing unit 120 includes the content structure information file 122, a scene information file group 123, and a monomedia information file group 124.

As can be seen from content structure information 122*a* shown in FIG. 3, the content structure information file 122 includes each definition (between tags <manual issue> and </manual issue>) of a manual event message. Note that tags <manual issue> and </manual issue> may be replaced with tags <receive> and </receive> whose names are derived from the fact that before receiving an operator's instruction to transmit a manual event message, the transmission system 110 "receives" the event message between the tags <manual issue> and </manual issue>.

FIG. 4 shows an example program list showing the content of the content structure information file 122. As shown in this drawing, the content structure information file 122 includes a description portion 122*b* (between tags <repetitive transmission> and </repetitive transmission>) that is written in a markup language and specifies information to be repeatedly broadcasted using a data carousel method, a description portion 122*c* (tags <audio . . . > and <video . . . >) that specifies the video and audio streams to be reproduced with a data broadcast, a statement 122*d* (a tag <event_msg . . . >) that defines a time event message, and manual event information 122*e* (between tags <manual issue> and </manual issue>) that is generated by the manual event message generating unit 101*a* and includes (defines) at least one manual event message.

Here, the attribute "start_time" shows the start time of the repetitive transmission using the data carousel method and the attribute "duration" shows how long the repetitive transmission should be performed. In this example, the data carousel is repeatedly transmitted for twenty minutes.

The portion between tags <module . . . > and </module> shows each module (unit data) to be transmitted with the data carousel method. Each tag <resource . . . > shows a material file used in one or more scenes, each attribute "type" shows the type of a file, and each attribute "src" shows a file name. In this example, the module named "Module 1" includes three scenes (scene information files) and one bitmap image (a monomedia information file).

The attribute "component_tag" in each of tags <audio . . . > and <video . . . > shows an audio stream or a video stream.

Each tag <event_msg . . . /> defines the construction element of an event message. Here, if the tag <event_msg . . . /> is sandwiched between the tags <manual issue> and </manual issue>(like the manual event information 122*e* in this drawing), this tag <event_msg . . . /> defines a manual event message.

The attributes "id", "message—id", "start time", "num_times", "interval", "private_data" in each tag <event_msg . . . /> give information concerning a corresponding event message and respectively shows the name, the message id, the transmission start time, the number of transmissions, the transmission interval (in units of milliseconds), and the message data (the content of the event message, such as the character string shown in this drawing) of the event message.

In this example, three manual event messages included in the manual event information 122*e* and one time event message 122*d* are defined in the content structure information file 122. As to the time event message (event message 1), it is programmed to repeatedly transmit the character string assigned a message ID "0001" ("This program has been sponsored . . . ") twenty times from "00:10:00" at intervals of five milliseconds. As to the manual event message (event message 2), it is programmed to repeatedly transmit the character string assigned a message ID "0002" ("Up-to-the-minute reports on election, . . . is projected to win") twenty times at intervals of five milliseconds immediately after an operator's instruction to transmit this message is received.

It should be noted here that each program related to an event message (a description concerning event processing) is arranged in the scene information file 123*a*, like in the conventional digital broadcasting system.

The content registering unit 130 reads the content 121 stored in the content storing unit 120, converts the read content to be in the MPEG2 section format, and registers the converted content at the content transmission control unit 512 of the transmission system 110 (transfers the converted content to the content transmission control unit 512). The content registering unit 130 includes specialized software for performing these operations, basic software (such as Windows (Microsoft Corp.)) on which the specialized software runs, and a personal computer.

The manual event message extracting unit 131 performs the following operations before the registration of the converted content by the content registering unit 130 is started. The manual event message extracting unit 131 extracts all of the manual event information 122*e* from the read content 121 and sends the manual event information 122*e* to the manual event message unit 113. Accordingly, the content registering unit 130 registers the content, from which the manual event information 122*e* has been extracted (deleted) by the manual event message extracting unit 131, at the transmission system 110.

The manual event message unit 113 is a terminal apparatus that includes a manual event message storing unit 113*a*, such as a hard disc drive apparatus, and displays a graphical user interface for the operator. In addition to the functions of the conventional manual event message unit 513, the manual event message unit 113 has a function of additionally storing each manual event message sent from the manual event message extracting unit 131 in the manual event message storing unit 113*a*.

That is, as shown in FIG. 3, each manual event message included in the content structure information 122*a* is transferred from the manual event message extracting unit 131 and is stored in the manual event message storing unit 113*a* as a transferred manual event message 113*b*.

This allows the operator to immediately issue each necessary manual event message merely by selecting the manual event message from a manual event message group (the group of event messages stored in the manual event message storing unit 113*a*) that is sent from the manual event message extracting unit 131. This saves the operator from generating each event message using the manual event message unit 113 in real time.

Figure 5:
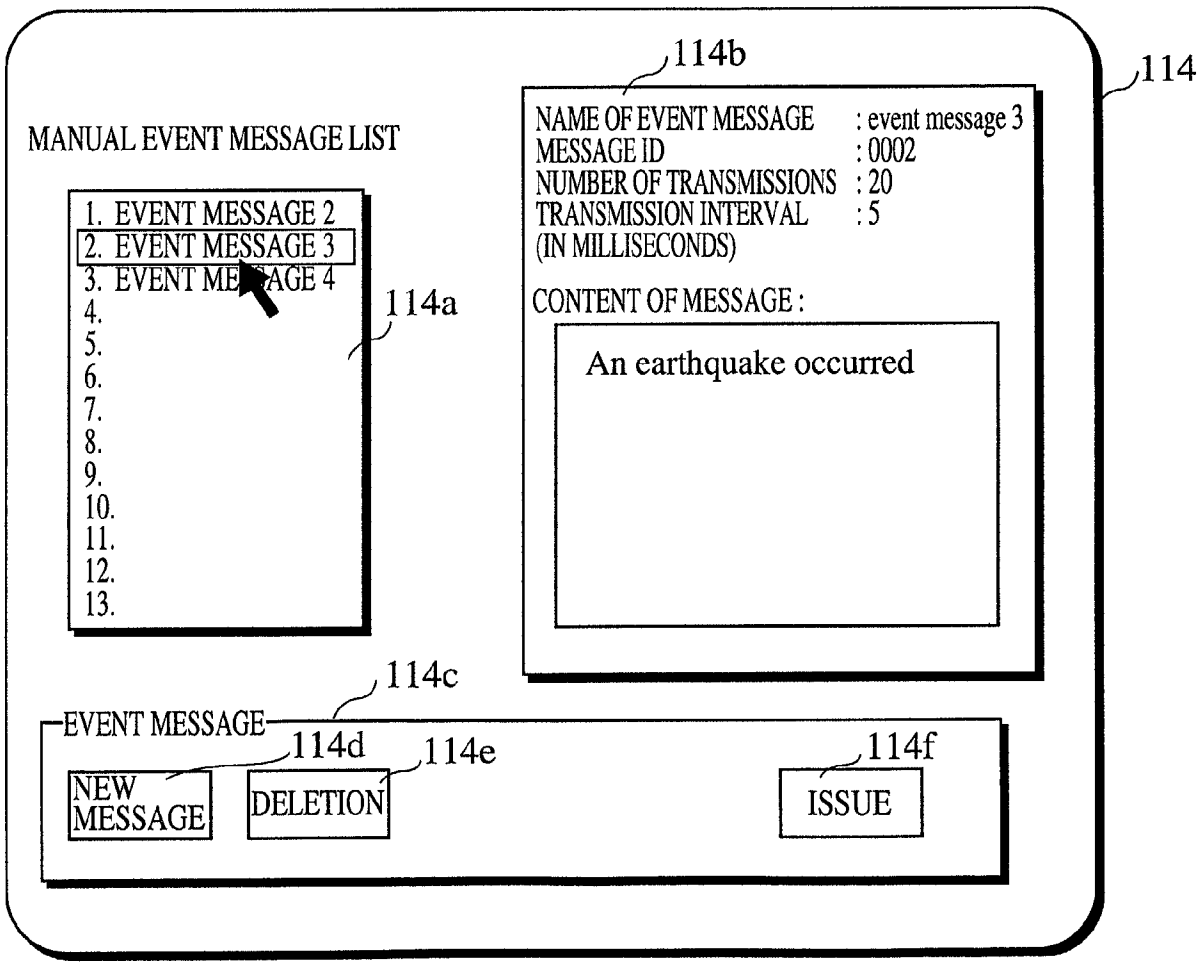
FIG. 5 shows an example display screen displayed by a manual event message generating and issuing unit.

FIG. 5 shows an example display screen displayed by the manual event message unit 113. As shown in this drawing, the display screen 114 includes a list 114*a* of names of the manual event messages 113*b* stored in the manual event message storing unit 113*a*, details 114*b* about an event message selected from the list 114*a*, and a button icon group 114*c* that allows the operator to input various instructions.

The event messages 2–4 on the list 114*a* correspond to three manual event messages included in the manual event information 122*e* shown in FIG. 4. These event messages are information that have been generated by the manual event message generating unit 101*a* of the authoring unit 101 according to instructions from the producer during the production of a content, stored in the content storing unit 120, sent to the content registering unit 130, extracted by the manual event message extracting unit 131, and registered at the manual event message unit 113 (transferred to the manual event message storing unit 113*a*).

The operator selects one of the event messages on the list 114*a*, checks the content of the selected event message, edits the selected event message, and immediately issues the edited event message by clicking on an issue button 114*f*. During these operations, the operator uses a mouse and keyboard. Note that like in the conventional digital broadcasting system, the operator also generates a new manual event message and registers the generated manual event message at the manual event message storing unit 113*a* by clicking on a new message button 114*d* and deletes a manual event message registered at the manual event message storing unit 113*a* by clicking on a deletion button 114*e*.

The operation procedure of the digital broadcasting system 100 having the stated construction is described below with reference to FIG. 6.

Figure 6:
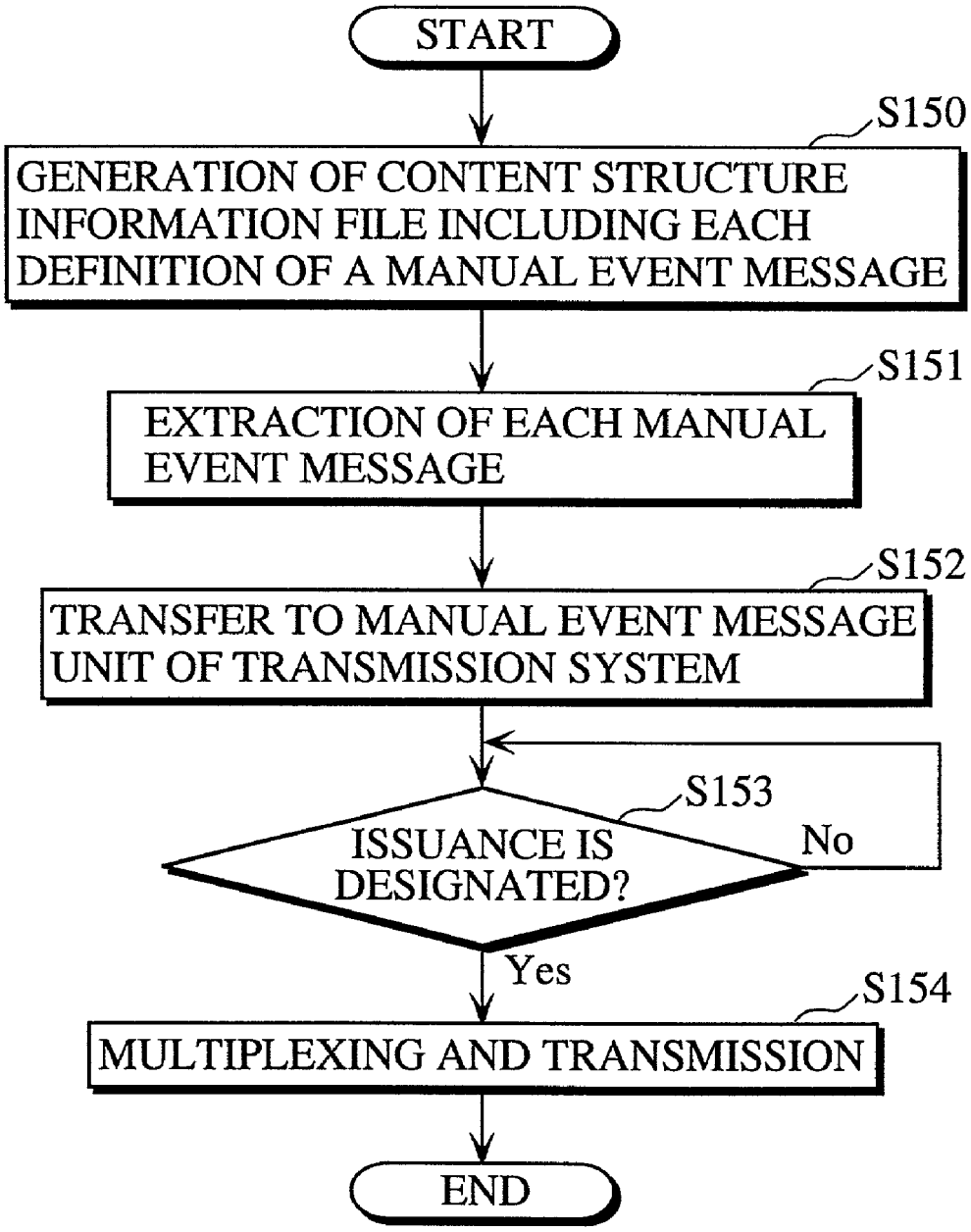
FIG. 6 is a flowchart showing the operation procedure of the digital broadcasting system from the generation of manual event messages to the issuance of the manual event messages.

FIG. 6 is a flowchart showing the operation procedure of the digital broadcasting system 100 from the generation of manual event messages to the issuance of the manual event messages.

According to instructions from the producer of the content 121, the manual event message generating unit 101*a* of the authoring unit 101 generates each manual event message (the manual event information 122*e*) between the tags <manual issue> and </manual issue> that defines a manual event message, embeds each generated manual event message into the content structure information file 122 along with other statements defining construction elements of the content 121, and outputs the content structure information file 122 to the content storing unit 120. In the content storing unit 120, the content structure information file 122 is stored along with the scene information file group 123 and the monomedia information file group 124 (step S150).

After the content registering unit 130 reads the content 121 from the content storing unit 120, the manual event message extracting unit 131 searches the content 121 (the content structure information file 122) for tags <manual issue> and </manual issue> to find the manual event information 122*e*. The manual event message extracting unit 131 then extracts the manual event information 122*e* from the content 121 and outputs the extracted manual event information 122*e* to the manual event message unit 113. The content registering unit 130 processes remaining information 122–124 and registers the processed information at the transmission system 110 (step S151).

After receiving each manual event message (the extracted manual event information 122*e*) from the manual event message extracting unit 131, the manual event message unit 113 additionally stores each received manual event message in the manual event message storing unit 113*a* (step S152).

The manual event message unit 113 displays a display screen through which the operator inputs various instructions. According to the instructions inputted by the operator, the manual event message unit 113 displays a list of event messages in the manual event message storing unit 113*a* and receives an operator's instruction to change, delete, or issue an event message on the list (step S153).

Immediately after receiving an operator's instruction to issue an event message on the list, the manual event message unit 113 reads the event message from the manual event message storing unit 113*a* and outputs message data, such as a character string, of the event message to the multiplexing unit 514 along with a corresponding message ID. The manual event message unit 113 performs this output operation according to the attributes of the event message, such as the number of transmissions and a transmission interval ("Yes" in step S153).

After receiving various information, such as the message data, from the manual event message unit 113, the multiplexing unit 514 generates packets from the received information, generates transmission data by multiplexing the packets with other packets generated from streams, and transmits the transmission data over a broadcasting wave (step S154).

Example display screens, which are displayed by a receiver (a television set) that receives a broadcast program from the digital broadcasting system 100, are described below with reference to FIGS. 7 and 8.

Figure 7:
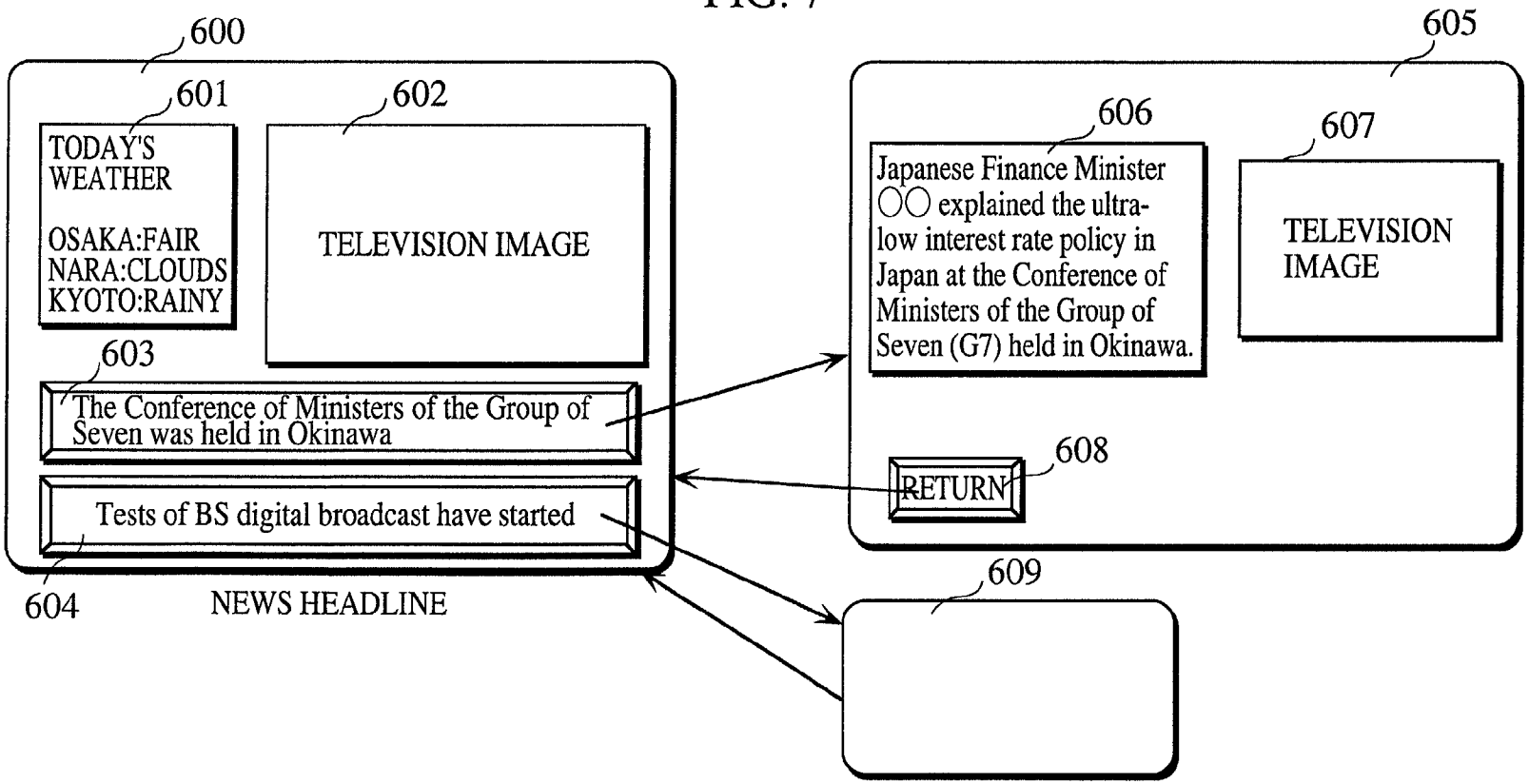
FIG. 7 shows example display screens that are displayed by a receiver, which receives a broadcast from the digital broadcasting system, before the receiver receives an event message.

FIG. 7 shows example display screens that are displayed before the receiver receives an event message.

The display screen 600 is a scene showing news headlines and includes various screen objects, such as weather information 601, a television image 602, and two buttons 603 and 604 linked to other scenes. The display screen 605 shows detailed news and is displayed when the button 603 in the display screen 600 is selected by the operator. Also, the display screen 609 shows detailed news and is displayed when the button 604 in the display screen 600 is selected by the operator. As shown in FIG. 7, the display screen 605 shows detailed news 606, a television image 607, and a return button 608 that is to be selected by the operator to return to the display screen 600. The display screens 600, 605, and 609, and the television image 602 respectively correspond to contents of descriptions "news headline.bml", "detailed news 1.bml", "detailed news 2.bml", and "news image 2" in the content structure information file 122 shown in FIG. 4.

Figure 8:
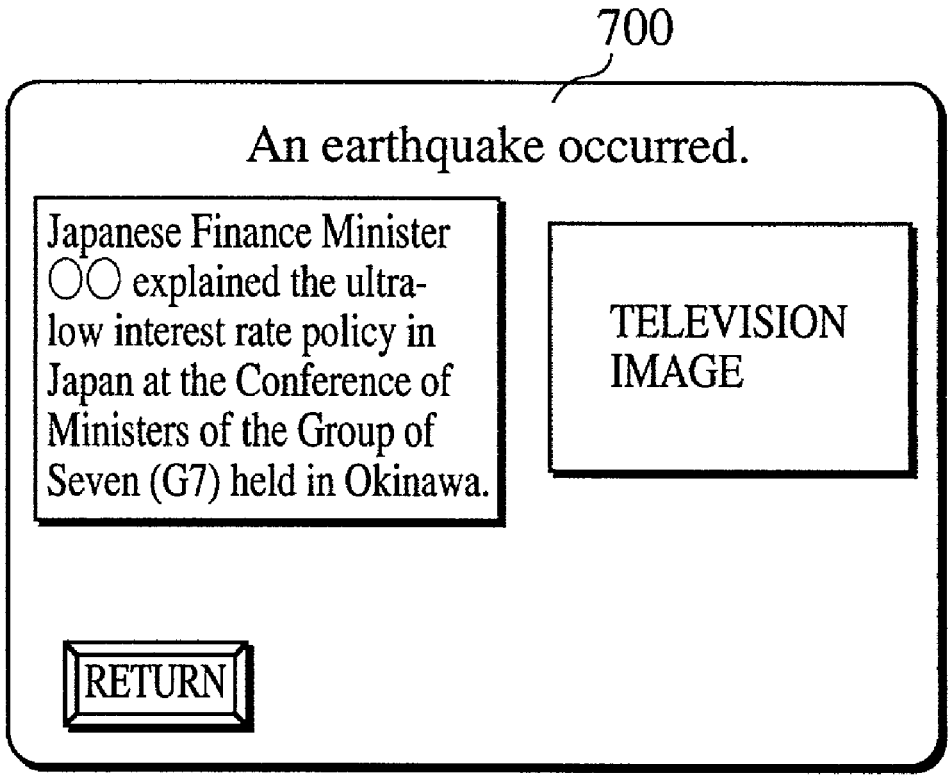
FIG. 8 shows an example display screen that is displayed by the receiver immediately after the receiver receives an event message.

FIG. 8 shows an example display screen that is displayed immediately after the receiver receives an event message.

The display screen 700 corresponds to the case where message data "An earthquake occurred" is displayed in the upper area of the display screen 605 (in FIG. 7) that shows detailed news. This example corresponds to the case where an event message (event message 3) whose message_id is "0003" is transmitted over a broadcasting wave and the scene file "detailed news 1.bml" shown in FIG. 4 includes a program for displaying the message data of the event message in the upper area of a current display screen immediately after the event message is received.

Each receiver that displays the content "detailed news 1.bml" executes the program included in the content. Therefore, while displaying this content, the receiver monitors broadcast data and checks whether an event message whose message_id is "0003" is transmitted. If the event message is transmitted, the receiver displays the message data "An earthquake occurred" included in the event message by superimposing the message data on a current display screen.

As described above, the digital broadcasting system 100 of the first embodiment allows a producer to produce manual event messages as well as programs for the event messages during the production of a content at the authorizing apparatus 11. This means that the digital broadcasting system 100 simplifies the operations concerning manual event messages that have conventionally been complicated because different apparatuses are used to write programs for manual event messages and to generate and issue the manual event messages.

The digital broadcasting system 100 also allows the producer to write manual event messages in advance during the production of a content. As a result, it is enough for the producer to generate and issue only event messages that becomes necessary later using the manual event message unit 113. Consequently, the digital broadcasting system 100 allows the producer to flexibly manage manual event messages.

Also, the digital broadcasting system 100 allows event processing to be programmed, with manual event messages being distinguished from time event messages. This is because, like the content structure information file shown in FIG. 4, different message IDs are used to define manual event messages and time event messages and the digital broadcasting system 100 distinguishes the manual event messages from the time event messages by referring to the message IDs.

<Second Embodiment>

The second embodiment of the digital broadcasting system of the present invention is described below with reference to the drawings.

Figure 9:
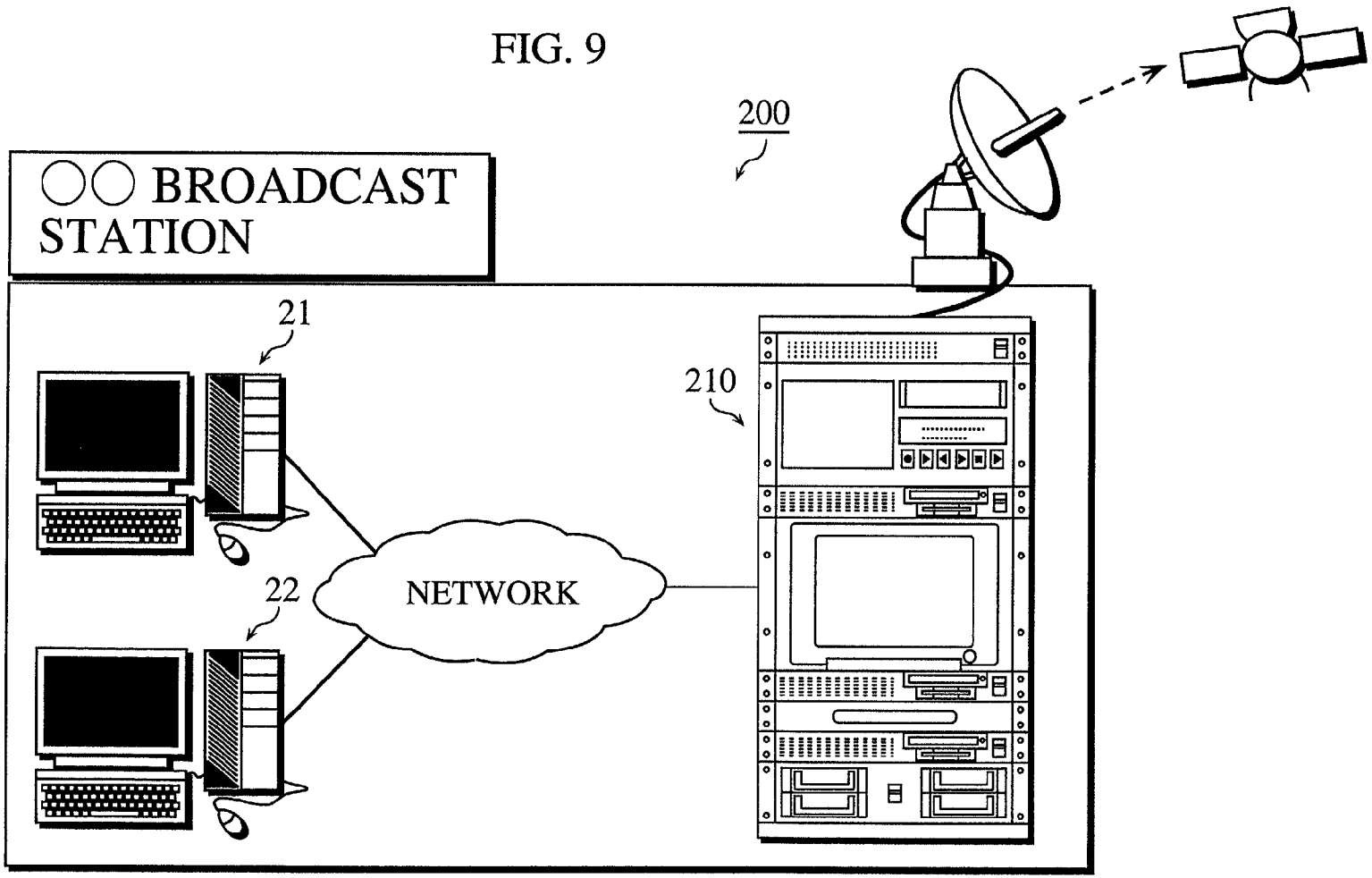
FIG. 9 shows the overall construction of a digital broadcasting system of the second embodiment.

FIG. 9 shows the overall construction of a digital broadcasting system 200 of the second embodiment. The digital broadcasting system 200 allows a producer to define each manual event message during the production of a content and to accumulate and issue each defined manual event message before registering the manual event messages at a transmission system. That is, the digital broadcasting system 200 allows the producer to perform these operations in an upstream process concerning manual event messages. As shown in FIG. 9, the digital broadcasting system 200 includes authorizing apparatuses 21 and 22 and a transmission system 210. In this system 200, the authoring apparatuses 21 and 22 are each connected to the transmission system 210 via a LAN (local area network). It should be noted here that the authoring apparatuses 21 and 22 have the same construction and so only the authorizing apparatus 21 is described below.

Figure 10:
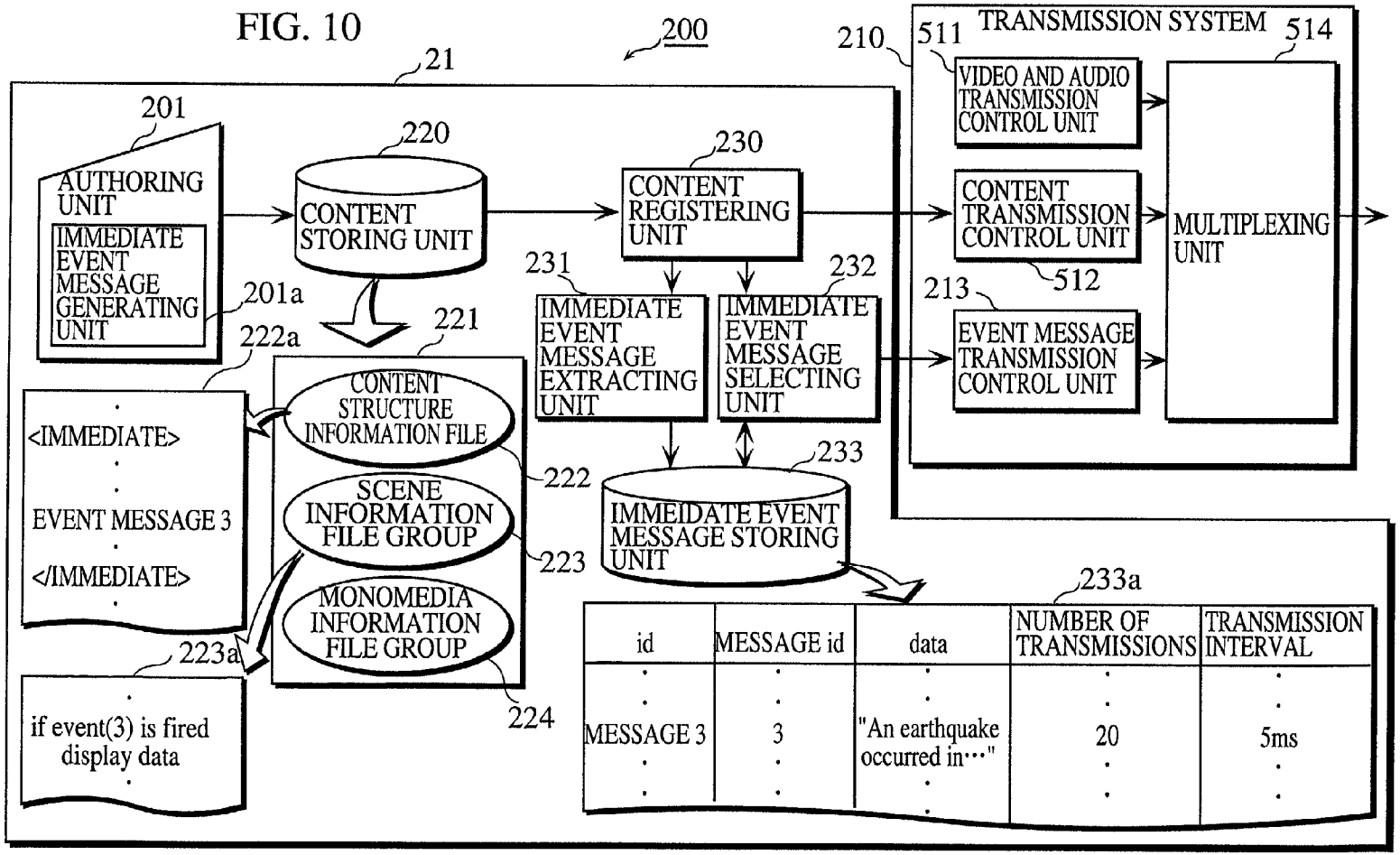
FIG. 10 is a functional block diagram showing the construction of the digital broadcasting system of the second embodiment.

FIG. 10 is a functional block diagram showing the construction of the digital broadcasting system 200 of the second embodiment.

As shown in this drawing, the authoring apparatus 21 includes an authoring unit 201, a content storing unit 220, a content registering unit 230, an immediate event message extracting unit 231, an immediate event message selecting unit 232, and an immediate event message storing unit 233.

Also, the transmission system 210 includes a video and audio transmission control unit 511, a content transmission control unit 512, an event message transmission control unit 213, and a multiplexing unit 514. The following description centers on the differences between the first and second embodiments.

The authoring unit 201 includes a characteristic construction element (an immediate event message generating unit 201*a*) that generates an immediate event message, in addition to the functions of the authoring unit 101 of the first embodiment.

Here, an immediate event message is a manual event message that is to be transmitted over a broadcasting wave immediately after being registered at (transferred to) the transmission system 210. That is, until an operator's instruction to issue the immediate event message is received, the immediate event message is not registered at the transmission system 210 and is accumulated in the authoring apparatus 21 that performs the upstream process concerning event messages. Immediately after an operator's instruction to issue the immediate event message is received, the event message is transferred to the transmission system 210 and is transmitted therefrom.

The immediate event message generating unit 201*a* provides a graphical user interface for a producer who is to define immediate event messages. Through the graphical user interface, the producer inputs various instructions and each description defining an immediate event message. As a result, the immediate event message generating unit 201*a* generates each statement that defines an immediate event message in a certain notation, embeds each generated statement into a content structure information file 222, and outputs the content structure information file 222 to the content storing unit 220.

The content storing unit 220 is a storing apparatus that stores contents produced by the authoring unit 201 and includes, for instance, a large-capacity hard disc drive. As can be seen from the content structure information 222*a* shown in FIG. 10, the content structure information file 222 includes each definition (between tags <immediate> and </immediate>) of an immediate event message. Note that tags <immediate> and </immediate> may be replaced with tags <after> and </after> whose names are derived from the fact that "after" receiving an operator's instruction to transmit an immediate event message, the transmission system 210 receives the event message between the tags <immediate> and </immediate>.

FIG. 11 shows an example program list showing the content of the content structure information file 222. As shown in this drawing, the content structure information file 222 includes immediate event information 222*b* (between tags <immediate> and</immediate>) that is generated by the immediate event message generating unit 201*a* and includes (defines) at least one immediate event message.

In this example, the immediate event information 222*b* defines three immediate event messages. As to the immediate event message (event message 4), it is programmed to repeatedly transmit the character string assigned a message ID "0004" ("The next is . . . ") twenty times at intervals of five milliseconds immediately after the event message is registered at the transmission system 210 according to an operator's instruction inputted at the authoring apparatus 21 to issue the event message.

It should be noted here that each program for an event message (a description concerning an event processing) is included in a scene information file 223*a*, like in the conventional digital broadcasting system.

The content registering unit 230 reads the content 221 from the content storing unit 220, converts the read content to be in the MPEG2 section format, and registers the converted content at the content transmission control unit 512 of the transmission system 210.

The immediate event message extracting unit 231 performs the following operations before the content registering unit 230 processes the content 221 read from the content storing unit 220. The immediate event message extracting unit 231 extracts the immediate event information 222*b* from the read content and stores the extracted immediate event information 222*b* in the immediate event message storing unit 233. Accordingly, the content registering unit 230 registers the content, from which the immediate event information 222*b* has been extracted (deleted) by the immediate event message extracting unit 231, at the transmission system 210.

The immediate event message storing unit 233 is a semiconductor memory or a large-capacity storing apparatus, such as a hard disc, and stores each immediate event message 233*a*, as shown in FIG. 10.

The immediate event message selecting unit 232 is, for instance, an intelligent terminal apparatus and provides a graphical user interface for the operator. According to the instructions inputted by the operator through the graphical user interface, the immediate event message selecting unit 232 displays and edits each necessary immediate event message 233*a* stored in the immediate event message storing unit 233. Immediately after receiving an operator's instruction to issue an immediate event message, the immediate event message selecting unit 232 reads the immediate event message from the immediate event message storing unit 233 and outputs the read immediate event message to the event message transmission control unit 213.

Figure 12:
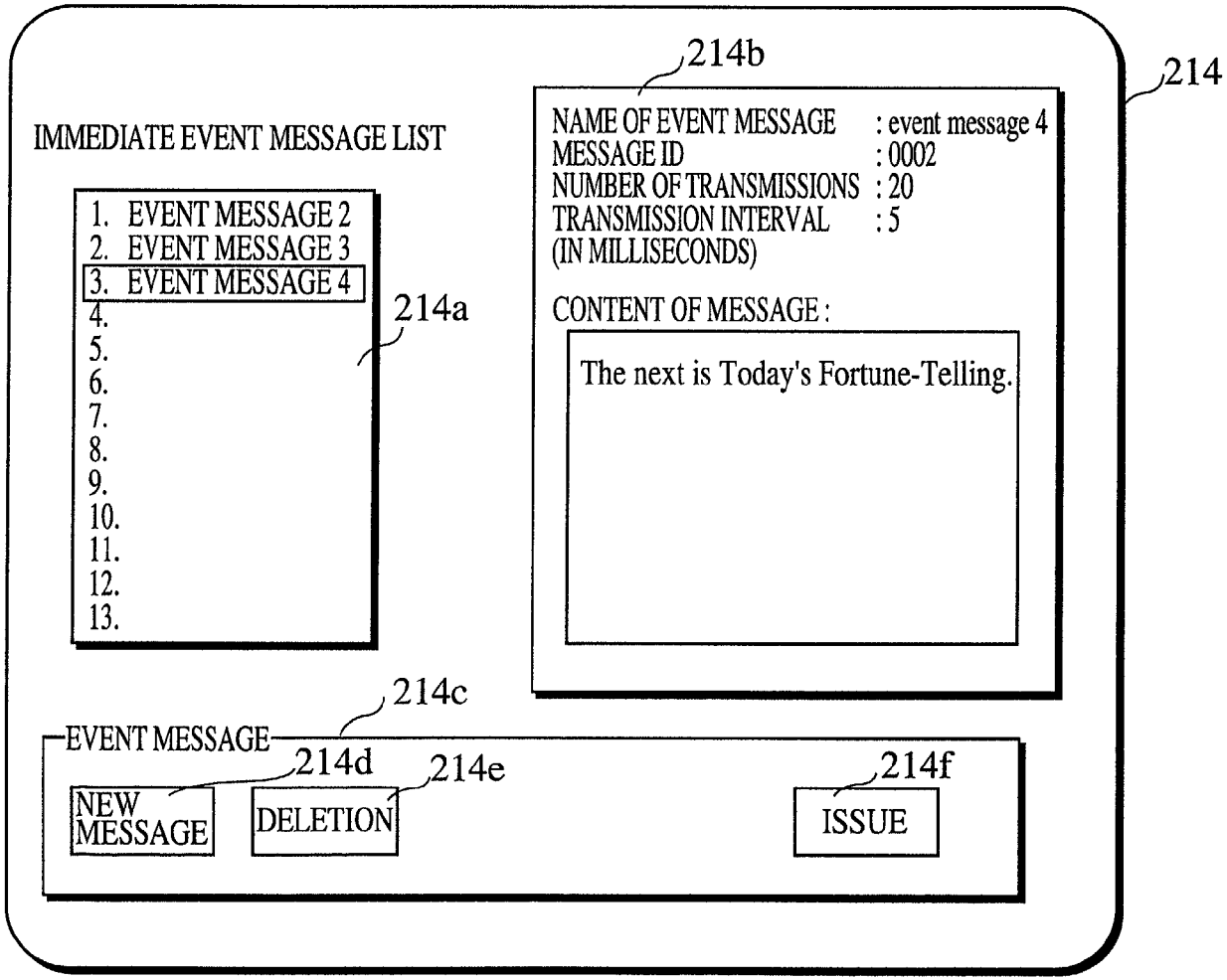
FIG. 12 shows an example display screen displayed by an immediate event message selecting unit.

FIG. 12 shows an-example display screen displayed by the immediate event message selecting unit 232. As shown in this drawing, the display screen 214 includes a list 214*a* of names of the immediate event messages 233*a* registered at the immediate event message storing unit 233, details 214*b* about an event message selected from the list 214*a*, and a button icon group 214*c* that allows the operator to input various instructions.

The event messages 2–4 on the list 214*a* correspond to three immediate event messages included in the immediate event information 222*b* shown in FIG. 11.

The operator selects one of the event messages on the list 214*a*, checks the content of the selected event message, edits the selected event message, and immediately issue the edited event message by clicking on an issue button 214*f*. During these operations, the operator uses a mouse and a keyboard. Note that like the operations using the manual event message unit 113 of the first embodiment, the operator also generates a new immediate event message and registers the generated immediate event message at the immediate event message storing unit 233 by clicking on a new message button 214*d* and deletes an immediate event message registered at the immediate event message storing unit 233 by clicking on a deletion button 214*e*. In addition to the functions of the conventional manual event message unit 513, the event message transmission control unit 213 has a function of sending each immediate event message to the multiplexing unit 514 immediately after receiving the immediate event message from the immediate event message selecting unit 232.

The operation procedure of the digital broadcasting system 200 having the stated construction is described below with reference to FIG. 13.

Figure 13:
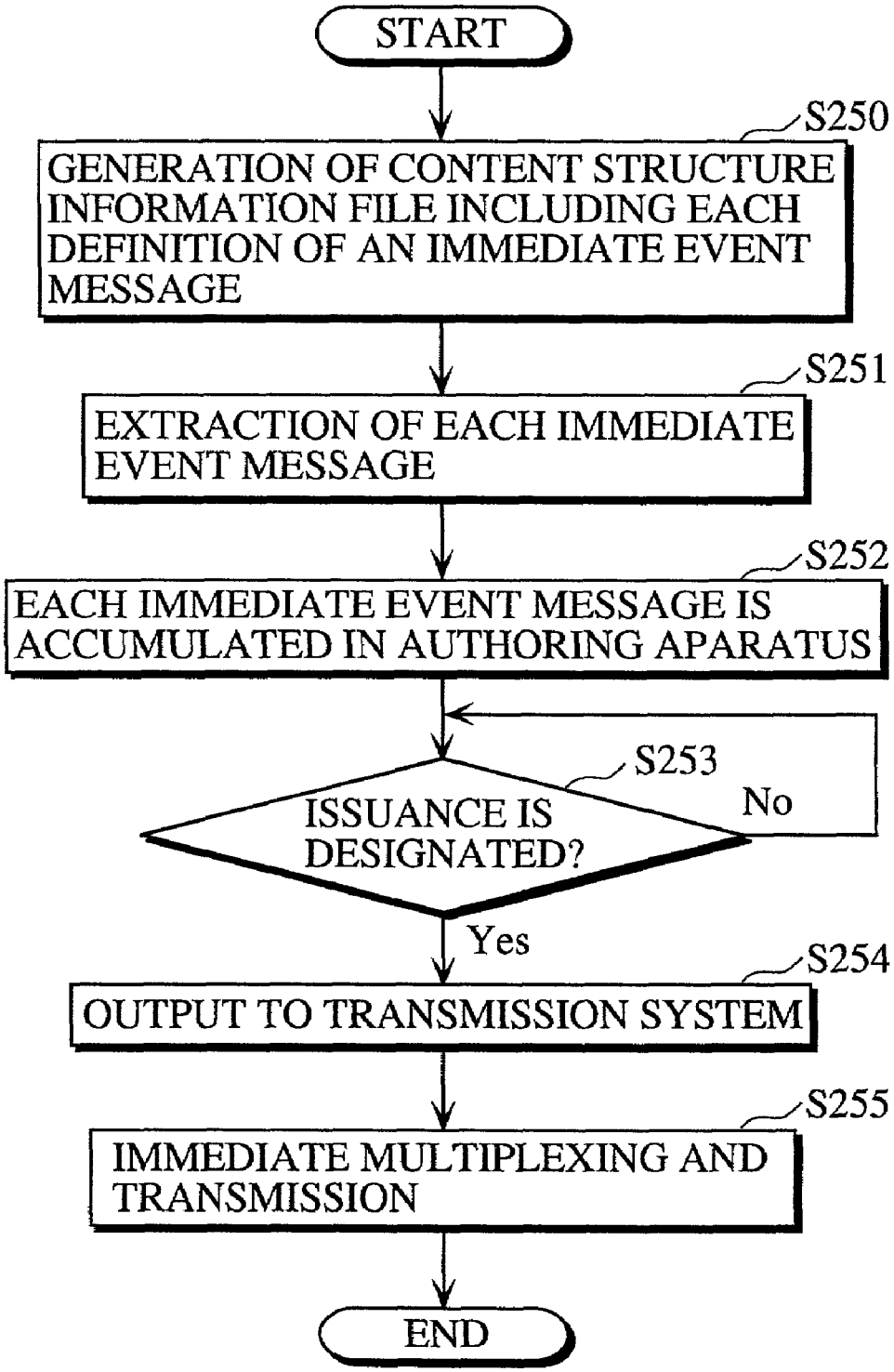
FIG. 13 is a flowchart showing the operation procedure of the digital broadcasting system from the generation of immediate event messages to the issuance of the immediate event messages.

FIG. 13 is a flowchart showing the operation procedure of the digital broadcasting system 200 from the generation of immediate event messages to the issuance of the immediate event messages.

According to instructions inputted by the producer of the content 221, the immediate event message generating unit 201*a* of the authoring unit 201 generates each immediate event message (the immediate event information 222*b*) between the tags <immediate> and </immediate>, embeds the generated immediate event information 222*b* into the content structure information file 222 along with other descriptions defining construction elements of the content, and outputs the content structure information file 222 to the content storing unit 220. In the content storing unit 220, the content structure information file 222 is stored along with the scene information file group 223 and the monomedia information file group 224 (step S250).

After the content registering unit 230 reads the content 221 from the content storing unit 220, the immediate event message extracting unit 231 searches the content 221 (the content structure information file 222) for tags <immediate> and </immediate> to find the immediate event information 222*b*. The immediate event message extracting unit 231 then extracts the immediate event information 222*b* from the content 221 (step S251) and stores the extracted immediate event information 222*b* in the immediate event message storing unit 233 (step S252).

The immediate event message selecting unit 232 receives instructions from the operator through a display screen. According to the instructions inputted by the operator, the immediate event message selecting unit 232 displays a list of the event messages stored in the immediate event message storing unit 233 and receives an operator's instruction to change, delete, or issue an event message on the list (step S253).

Immediately after receiving an operator's instruction to issue an event message on the list, the immediate event message selecting unit 232 reads the event message from the immediate event message storing unit 233 and outputs message data, such as a character string, of the event message to the event message transmission control unit 213 along with a corresponding message ID. The immediate event message selecting unit 232 performs this processing according to the attributes of the event message, such as the number of transmissions and a transmission interval (step S254).

After receiving various information, such as the message data, from the immediate event message selecting unit 232, the event message transmission control unit 213 sends the various information to the multiplexing unit 514. The multiplexing unit 514 generates packets from the received information in real time, generates transmission data by multiplexing the packets with other packets generated from streams, and transmits the transmission data over a broadcasting wave (step S255).

As described above, the digital broadcasting system 200 of the second embodiment allows a producer to produce immediate event messages as well as programs for the event messages during the production of a content at the authorizing apparatus 21. Each of the generated immediate event messages is accumulated in the authoring apparatus 21 (in an upstream process) and is issued through the transmission system 210 immediately after an operator's instruction to issue the event message is received.

This allows operations concerning event messages to be performed smoothly because the generation, accumulation, and issuance of each immediate event message, that is a type of manual event message, is performed in an upstream process using an apparatus other than the transmission system 210.

That is, the digital broadcasting system 200 allows a producer to generate event messages in advance during the production of a content even if it is unsure whether the event messages needs to be issued. When it becomes necessary to issue the generated event messages, the producer immediately issues the event messages without operating the transmission system 210.

<Third Embodiment>

The third embodiment of the digital broadcasting system of the present invention is described below with reference to the drawings.

Figure 14:
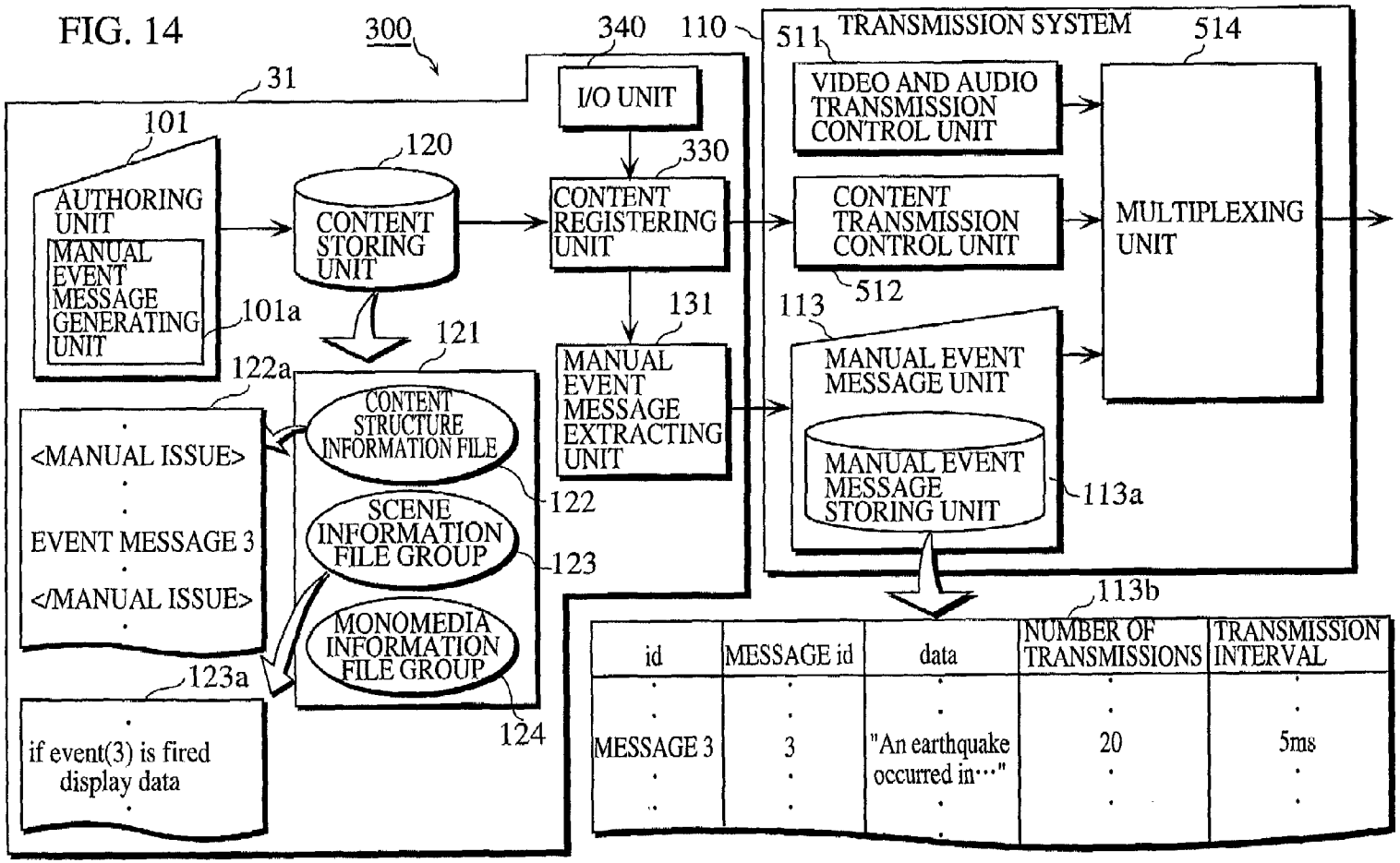
FIG. 14 is a functional block diagram showing the construction of a digital broadcasting system of the third embodiment.

FIG. 14 is a functional block diagram showing the construction of a digital broadcasting system 300 of the third embodiment. The digital broadcasting system 300 allows manual event messages, which are included in contents produced at other authoring apparatuses, to be read during the production of a content. An authoring apparatus 31 shown in FIG. 14 differs from the authoring apparatus 11 of the first embodiment (see FIG. 3) in that the authoring apparatus 31 includes a content registering unit 330 instead of the content registering unit 130 and additionally includes an I/O unit 340. Note that the same construction elements as those in the first embodiment are assigned the same reference numbers and are not described here. Therefore, the following description centers on the construction elements unique to the third embodiment.

The content registering unit 330 has a function of reading contents generated by other authoring apparatuses via the I/O unit 340, in addition to the functions of the content registering unit 130 of the first embodiment.

The I/O unit 340 is an I/O port included in the content registering unit 330 and a recording medium reading apparatus is connected to the I/O port. Note that the connected recording medium reading apparatus is, for instance, a floppy disc drive, a CD-ROM drive, a DVD-ROM drive, a DVD-RAM drive, or an MO drive.

That is, in addition to the functions of the content registering unit 130 of the first embodiment, the content registering unit 330 reads contents, which have been generated by other authoring apparatuses, from a recording medium. The content registering unit 330 then performs the same processing as the content registering unit 130 on each read content.

It should be noted here that the I/O unit 340 may be an NIC (network interface card). In this case, the content registering unit 330 reads contents from a NAS (network attached storage), a SAN (storage area network), or a file server apparatus, each of which stores contents generated by other authoring apparatuses, via a network connected to the NIC.

The digital broadcasting system to which the present invention is applied has been described above by means of the embodiments, although it should be obvious that the present invention is not limited to the examples described above. Further variations are described below.

In the embodiments described above, each statement defining an event message is written in a content structure information file. However, the present invention is not limited to this. For instance, each statement defining a manual event message may be written in an external reference file 401 that is different from a content structure information file 400, as shown in FIG. 15. In this case, a pointer to the external reference file is written in the content structure information file 400.

Also, the first and second embodiments may be combined to realize a modified digital broadcasting system where the construction elements 101*a* and 131 unique to the first embodiment and the construction elements 201*a* and 231–233 unique to the second embodiment are added to a conventional digital broadcasting system.

In this case, an advanced digital broadcasting system is realized that allows a producer to simultaneously produce the first event messages (such as manual event messages) and the second event messages (such as immediate event messages), with the first event messages being distinguished from the second event messages. That is, this digital broadcasting system allows event processing to be programmed, with the first event messages being distinguished from the second event messages.

The characteristic construction elements of the present invention, such as the construction elements 101*a*, 131, 201*a*, 231, and 232 of the embodiments, may be realized as programs that are executed by a general-purpose computer. Also, the programs may be distributed using recording media, such as CD-ROMs, or via transmission media, such as communication networks. Further, the data files 122, 222, 400, and 401 that contain characteristic event message define statements of the present invention may also be distributed using recording media or via transmission media.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A digital broadcasting system comprising:

an authoring apparatus and a transmission apparatus that transmits a content transferred from the authoring apparatus, wherein the authoring apparatus includes:

a generating means for generating event information, which defines an event message that should be transmitted immediately after an operator's instruction to transmit the event message is inputted;

a processing means for processing a content, which should be transferred to the transmission apparatus, by adding the generated event information; and an extracting means for extracting the event information from the processed content by referring to the tag information; and a transferring means for transferring the extracted event information to the transmission apparatus, and the transmission apparatus includes:

a storing means for storing the event message included in the event information transferred from the authoring apparatus;

an issuing means for issuing the event message stored in the storing means by receiving the operator's instruction; and a multiplexing means for multiplexing and transmitting the issued event message with a content that has been transferred from the authoring apparatus, wherein the generated event information includes the event message and tag information, the tag information allowing the authoring apparatus to recognize that the event message should be (a) transferred to the transmission apparatus before the operator's instruction is inputted and (b) transmitted from the transmission apparatus immediately after the operator's instruction is inputted.

2. The digital broadcasting system of claim 1, wherein the authoring apparatus further includes an obtaining means for obtaining a content, to which event information has been added, from the outside, and the extracting means extracts the event information from the obtained content.

3. The digital broadcasting system of claim 2, wherein the obtaining means obtains a content, to which event information has been added, from a transportable recording medium.

4. The digital broadcasting system of claim 2, wherein the obtaining means obtains a content, to which event information has been added, via a network.

5. A digital broadcasting system comprising an authoring apparatus and a transmission apparatus that transmits a content transferred from the authoring apparatus, wherein the authoring apparatus includes;

a generating means for generating event information, which defines an event message that should be transmitted immediately after an operator's instruction to transmit the event message is inputted, and a processing means for processing a content, which should be transferred to the transmission apparatus, by adding the generated event information, wherein the generated event information includes the event message and tag information, the tag information allowing the authoring apparatus to recognize that the event message should be issued to the transmission apparatus and transmitted therefrom immediately after the operator's instruction is inputted, wherein the authoring apparatus further includes:

an extracting means for extracting the event information from the processed content by referring to the tag information;

a storing means for storing the event message included in the extracted event information; and an issuing means for issuing the event message stored in the storing means to the transmission apparatus by receiving the operator's instruction, and the transmission apparatus includes:

a multiplexing means for multiplexing and transmitting the issued event message with a content that has bean transferred from the authoring apparatus.

6. The digital broadcasting system of claim 5, wherein the authoring apparatus further includes an obtaining means for obtaining a content, to which event information has been added, from the outside, and the extracting means extracts the event information from the obtained content.

7. The digital broadcasting system of claim 6, wherein the obtaining means obtains a content, to which event information has been added, from a transportable recording medium.

8. The digital broadcasting system of claim 6, wherein the obtaining means obtains a content, to which event information has been added, via a network.

9. An authoring apparatus comprising:

a generating means for generating event information, which defines an event message that should be transmitted immediately after an operator's instruction to transmit the event message is inputted, wherein the generated event information includes the event message and tag information, the tag information allowing the authoring apparatus to recognize that the event message should be (a) transferred to the transmission apparatus before the operator's instruction is inputted and (b) transmitted from the transmission apparatus immediately after the operator's instruction is inputted;

a processing means for processing a content, which should be transferred to a transmission apparatus, by adding the generated event information;

an extracting means for extracting the event information from the processed content by referring to the tag information; and a tranferring means for transferring the extracted event information to the transmission apparatus.

10. The authoring apparatus of claim 9 further comprising:

an obtaining means for obtaining a content, to which event information has been added, from the outside, wherein the extracting means extracts the event information from the obtained content.

11. The authoring apparatus of claim 10, wherein the obtaining means obtains a content, to which event information has been added, from a transportable recording medium.

12. The authoring apparatus of claim 10, wherein the obtaining means obtains a content, to which event information has been added, via a network.

13. An authoring apparatus comprising:

a generating means for generating event information, which defines an event message that should be transmitted immediately after an operator's instruction to transmit the event message is inputted, wherein the generated event information includes the event message and tag information, the tag information allowing the authoring apparatus to recognize that the event message should be issued to the transmission apparatus and transmitted therefrom immediately after the operator's instruction is inputted;

a processing means for processing a content, which should be transferred to a transmission apparatus, by adding the generated event information;

an extracting means for extracting the event information from the processed content by referring to the tag information;

a storing means for storing the event message included in the extracted event information; and an issuing means for issuing the event message stored in the storing means to the transmission apparatus by receiving the operator's instruction.

14. The authoring apparatus of claim 13 further comprising:

an obtaining means for obtaining a content, to which event information has been added, from the outside, wherein the extracting means extracts the event information from the obtained content.

15. The authoring apparatus of claim 14, wherein the obtaining means obtains a content to which event information has been added, from a transportable recording medium.

16. The authoring apparatus of claim 14, wherein the obtaining means obtains a content, to which event information has been added, via a network.

17. An event message transmission method for use in a digital broadcasting system including an authoring apparatus and a transmission apparatus that transmits a content transferred from the authoring apparatus, the event message transmission method comprising:

a generating step for generating event information, which defines an event message that should be transmitted immediately after an operator's instruction to transmit the event message is inputted, wherein the generated event information includes the event message and tag information, the tag information allowing the authoring apparatus to recognize that the event message should be (a) transferred to the transmission apparatus before the operator's instruction is inputted and (b) transmitted from the transmission apparatus immediately after the operator's instruction is inputted;

a processing step for processing a content, which should be transferred to the transmission apparatus, by adding the generated event information, an extracting step for extracting the event information from the processed content by referring to the tag information;

a transferring step for transferring the extracted event information to the transmission apparatus, a storing step for storing, in a storing unit of the transmission apparatus, the event message included in the event information transferred from the authoring apparatus;

an issuing step for issuing the event message stored in the storing unit by receiving the operator's instruction; and a multiplexing step for multiplexing and transmitting the issued event message with a content that has been transferred from the authoring apparatus.

18. The event message transmission method of claim 17 further comprising:

an obtaining step for obtaining a content, to which event information has been added, from the outside, wherein the extracting step extracts the event information from the obtained content.

19. The event message transmission method of claim 18, wherein the obtaining step obtains a content, to which event information has been added, from a transportable recording medium.

20. The event message transmission method of claim 18, wherein the obtaining step obtains a content, to which event information has been added, via a network.

21. An event message transmission method for use in a digital broadcasting system comprising an authoring apparatus and a transmission apparatus that transmits a content transferred from the authoring apparatus, the event message transmission method comprising:

a generating step for generating event information, which defines an event message that should be transmitted immediately after an operator's instruction to transmit the event message is inputted, wherein the generated event information includes the event message and tag information, the tag information allowing the authoring apparatus to recognize that the event message should be issued to the transmission apparatus and transmitted therefrom immediately after the operator's instruction is inputted;

a processing step for processing a content, which should be transferred to the transmission apparatus, by adding the generated event information, an extracting step for extracting the event information from the processed content by referring to the tag information;

a storing step for storing, in a storing unit of the authoring apparatus, the event message included in the extracted event information;

an issuing step for issuing the event message stored in the storing unit to the transmission apparatus by receiving the operator's instruction; and a multiplexing step for multiplexing and transmitting the issued event message with a content that has been transferred from the authoring apparatus.

22. The event message transmission method of claim 21 further comprising:

an obtaining step for obtaining a content, to which event information has been added, from the outside, wherein the extracting step extracts the event information from the obtained content.

23. The event message transmission method of claim 22, wherein the obtaining step obtains a content, to which event information has been added, from a transportable recording medium.

24. The event message transmission method of claim 22, wherein the obtaining step obtains a content, to which event information has been added, via a network.

25. An event message generating method used by an authoring apparatus, comprising:

a generating step for generating event information, which defines an event message that should be transmitted immediately after an operator's instruction to transmit the event message is inputted, wherein the generated event information includes the event message and tag information, the tag information allowing the authoring apparatus to recognize that the event message should be (a) transferred to the transmission apparatus before the operator's instruction is inputted and (b) transmitted from the transmission apparatus immediately after the operator's instruction is inputted;

a processing step for processing a content, which should be transferred to a transmission apparatus, by adding the generated event information;

an extracting step for extracting the event information from the processed content by referring to the tag information; and a transferring step for transferring the extracted event information to the transmission apparatus.

26. The event message generating method of claim 25 further comprising:

an obtaining step for obtaining a content, to which event information has been added, from the outside, wherein the extracting step extracts the event information from the obtained content.

27. The event message generating method of claim 26, wherein the obtaining step obtains a content, to which event information has been added, from a transportable recording medium.

28. The event message generating method of claim 26, wherein the obtaining step obtains a content, to which event information has been added, via a network.

29. An event message generating method used by an authoring apparatus, comprising:

a generating step for generating event information, which defines an event message that should be transmitted immediately after an operator's instruction to transmit the event message is inputted, wherein the generated event information includes to event message and tag information, the tag information allowing the authoring apparatus to recognize that the event message should be issued to the transmission apparatus and transmitted therefrom immediately after the operator's instruction is inputted;

a processing step for processing a content, which should be transferred to a transmission apparatus, by adding the generated event information;

an extracting step for extracting the event information from the processed content by referring to the tag information;

a storing step for storing, in a storing unit of the authoring apparatus, to event message included in the extracted event information; and an issuing step for issuing the event message stored in the storing unit to the transmission apparatus by receiving the operator's instruction.

30. The event message generating method of claim 29 further comprising:

an obtaining step for obtaining a content, to which event information has been added, from the outside, wherein the extracting step extracts the event information from the obtained content.

31. The event message generating method of claim 30, wherein the obtaining step obtains a content, to which event information has been added, from a transportable recording medium.

32. The event message generating method of claim 30, wherein the obtaining step obtains a content, to which event information has been added, via a network.

* * * * *

UNITED STATES PATENT AND TRADEMARK OFFICE

CERTIFICATE OF CORRECTION

PATENT NO. : 7,028,324 B2
APPLICATION NO. : 09/777023
DATED : April 11, 2006
INVENTOR(S) : Hidekazu Shimizu et al.

It is certified that error appears in the above-identified patent and that said Letters Patent is hereby corrected as shown below:

In Claim 5, Column 17, line 11, the semicolon after "includes" should be a colon":"
In Claim 5, Column 17, line 36, "bean" should be "been".
In Claim 15, Column 18, line 48, a comma shoul;d be added after the word "content".

Signed and Sealed this

Fifteenth Day of August, 2006

JON W. DUDAS
*Director of the United States Patent and Trademark Office*